US006874869B1

(12) United States Patent
Hollands et al.

(10) Patent No.: US 6,874,869 B1
(45) Date of Patent: Apr. 5, 2005

(54) INKJET PRINTHEAD

(75) Inventors: Peter Joseph Hollands, Baarlo (NL); Hendrik Willem Ellenkamp, Venlo (NL)

(73) Assignee: Océ-Technologies B.B., Ma Venlo (NL)

( * ) Notice: Subject to any disclaimer, the term of this patent is extended or adjusted under 35 U.S.C. 154(b) by 0 days.

(21) Appl. No.: 09/482,888

(22) Filed: Jan. 14, 2000

(30) Foreign Application Priority Data

Jan. 22, 1999 (EP) ..... 99200195

(51) Int. Cl.[7] ..... B41J 2/045
(52) U.S. Cl. ..... 347/68; 347/70
(58) Field of Search ..... 347/68, 70–72; 310/328, 330, 332

(56) References Cited

U.S. PATENT DOCUMENTS 4,611,219 A * 9/1986 Sugitani et al. ..... 347/40
4,924,241 A 5/1990 Parks et al. ..... 347/54
5,659,346 A * 8/1997 Moynihan et al. ..... 347/70
5,831,651 A * 11/1998 Usui et al. ..... 347/70
6,036,303 A * 3/2000 Yamamoto et al. ..... 347/70
6,142,616 A * 11/2000 Akahane ..... 347/71

FOREIGN PATENT DOCUMENTS

DE 3820082 * 12/1988 ..... B41J/3/04
DE 3820082 A1 * 12/1988 ..... 347/71
EP A20671372 9/1995 ..... C04B/37/04
EP A10786342 7/1997 ..... B41J/2/045
EP A10819527 1/1998 ..... B41J/2/045

* cited by examiner

*Primary Examiner*—Thinh Nguyen
*Assistant Examiner*—Julian Huffman
(74) *Attorney, Agent, or Firm*—Birch, Stewart, Kolasch & Birch, LLP

(57) ABSTRACT

An ink jet printhead comprising a channel plate having a plurality of ink channels etched into at least one surface thereof, actuators respectively associated with each of the ink channels for pressurizing ink contained in the ink channels, and means defining an ink reservoir communicating with the ink channels, wherein said ink reservoir is defined by a base member made of a material different from that of the channel plate.

8 Claims, 1 Drawing Sheet

INKJET PRINTHEAD

BACKGROUND OF THE INVENTION

The present invention relates to an ink jet printhead comprising a channel plate having a plurality of ink channels etched into at least one surface thereof, actuators respectively associated with each of the ink channels for pressurizing ink contained in the ink channels, and means defining an ink reservoir communicating with the ink channels. The present invention also relates to a method for manufacturing such a printhead.

An example of a conventional printhead of this type is described in EP-A-0 671 372. The ink channels are arranged side-by-side in one surface of the channel plate and extend in parallel to one another with narrow spacings formed therebetween. Each ink channel converges into a nozzle at one end thereof, so that an array of nozzles is formed, by which a plurality of ink droplets can be expelled simultaneously by energizing the actuators respectively associated with the ink channels. For a high-resolution printer, it is required that the spacings between the adjacent nozzles are made as small as possible, and, accordingly, the ink channels and the wall portions separating them must have very small dimensions in the width direction.

The ink reservoir defining means and the channel plate are formed by a one-piece substrate made of a material such as silicon, in which the ink channels can be formed by photolithographic etching. This has the advantage that the minute structures of the ink channels and the nozzles can be formed with high accuracy. Cavities defining the ink reservoir and supply passages connecting the ink reservoir to each of the ink channels are formed directly in the silicon substrate by etching away appropriate portions of the substrate.

As an alternative, it has been proposed to form the channel plate and the ink reservoir defining means by a one-piece block of graphite. In this case, however, the ink channels must be cut into the surface of the channel plate, and the process of forming the minute structures of the ink channels and nozzles becomes more cumbersome or a graphite with a very small grain size must be used which makes the inkjet printhead expensive.

SUMMARY OF THE INVENTION

It is an object of the present invention to provide an ink jet printhead, which can be manufactured at low costs and in which the ink channels can be formed with reproducible high accuracy.

According to the present invention, this object is achieved by the feature wherein the ink reservoir defining means are formed by a base member made of a material different from that of the channel plate.

As a result, it is not necessary to form the comparatively large volume of the ink reservoir in a time-consuming etching process, and the rather bulky member of the printhead in which the ink reservoir is formed can be manufactured at low costs by molding, sintering or machining a rather inexpensive material such as graphite or ceramic in a relatively grainy form. Only the comparatively small volume of the channel plate is made from expensive materials such as silicon, fine grain graphite, ceramics, etc., in which the fine structures of the ink channels, and, as the case may be, the nozzles, can be formed with high accuracy in an etching or mechanical process in which only a small amount of material has to be removed. Thus, not only the costs for the material but also the costs for the manufacturing process can be reduced significantly.

In a preferred embodiment the channel plate and the member defining the ink reservoir are manufactured as separate members and are then buttingly assembled together and fixed to one another, e.g. by bonding, so that fluid connections between the ink reservoir and each of the ink channels are established. In this case, the ink channels can be etched or machined before the channel plate and the ink reservoir defining member are assembled, so that the apparatus needs to have only small dimensions and/or a large number of channel plates can be etched simultaneously.

As an alternative, it would also be possible that the etchable material, e.g. silicon, is directly deposited on a portion of the member defining the ink reservoir, and then the ink channels are formed by etching.

In a preferred design of an ink jet printhead the nozzles are arranged in two parallel rows. In this case, the ink channels associated with the respective rows of nozzles can either be formed in opposite surfaces of a single channel plate or can be formed in the surfaces of separate channel plates sandwiched with a portion of the ink reservoir defining member. In the latter case, a large area of contact between the channel plates and the ink reservoir defining member is achieved, and, accordingly, there is a good thermal contact between the ink reservoir defining member and the channel plates, which is particularly advantageous in case of a hot-melt printhead in which the ink contained in the ink reservoir and the ink channels needs to be liquefied by heating.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
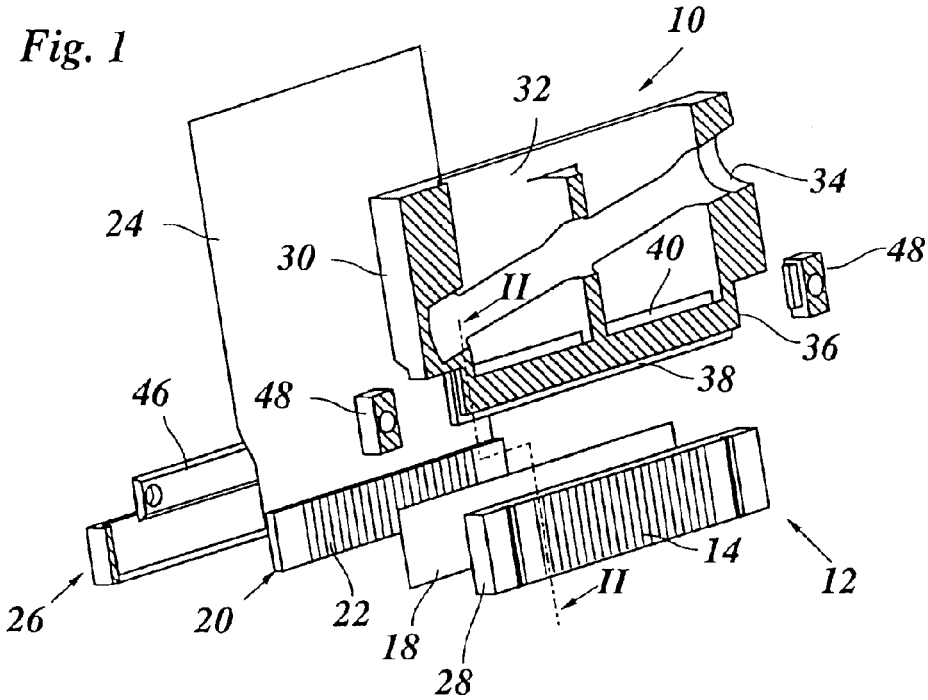
FIG. 1 is a longitudinally sectioned perspective exploded view of a printhead according to the present invention.
Figure 2:
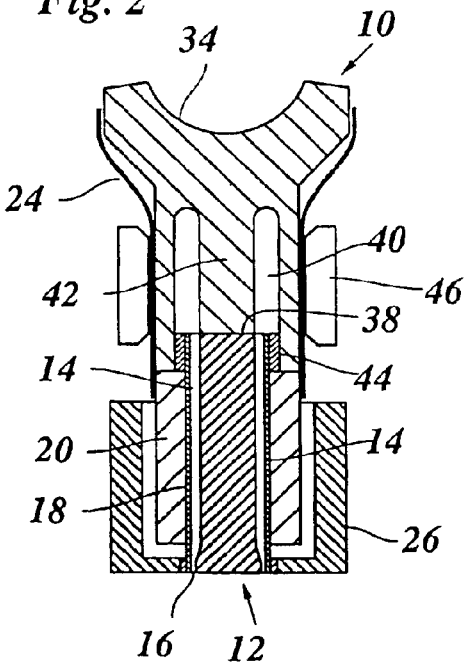
FIG. 2 is an enlarged cross-sectional view of a lower portion of the printhead shown in FIG. 1, the cross-section being taken along the line II—II of FIG. 1.

As is shown in FIGS. 1 and 2, an ink jet printhead according to the present invention has a symmetric structure and comprises as main components a base plate 10 made of graphite or ceramic and a channel plate 12 made of an etchable material, preferably a semiconductor material such as silicon. The channel plate 12 has opposite lateral surfaces in which a plurality of parallel, vertically extending ink channels 14 are formed by etching. Each ink channel 14 is converged to form a nozzle 16 (FIG. 2) at the lower end thereof and is open at its top end. The open lateral sides of the ink channels 14 and the nozzles 16 are covered by a flexible sheet 18 made of the same material as the channel plate 12 and firmly bonded thereto. An actuator block 20 is bonded to the outer surface of each sheet 18. The actuator block 20 is made of a piezoelectric ceramic material and has a comb-like structure forming a plurality of parallel, vertically extending piezoelectric fingers 22 and is provided with electrodes (not shown) associated with each of the fingers 22. A flexible lead foil 24 is attached to the outer surface of each of the actuator blocks 20 and is formed with electric leads for individually energizing the piezoelectric fingers 22.

The actuator blocks 20 are protected by a cap 26 fitted over the lower end of the channel plate 12 and bonded to the lower edges of the sheets 18 and to the end faces 28 of the channel plate 12.

The base member 10 is a plate-like member having a comparatively thick top portion 30 in which are formed an ink reservoir 32 and a receptacle 34 for a filter element (not shown). A lower portion 36 of the base plate 10 has a reduced thickness and width and is formed with a recess 38 extending along its lower edge. Ink supply passages 40 are symmetrically formed in the cross section of the lower portion 36 of the base plate. The ink supply passages 40 are in fluid communication with the ink reservoir 32 and are open to the bottom of the recess 38.

As is shown in FIG. 2, the channel plate 12, the flexible sheets 18 and the actuator blocks 20 form a unit which is fitted to the lower edge of the base plate 10, so that the top portions of the channel plate 12 and the sheets 18 project into the recess 38. The thickness of the channel plate 12 is larger than the thickness of a web portion 42 of the base plate 10, separating the ink supply passages 40. Thus, the open ends of the ink channels 14 are in fluid communication with the ink reservoir 32 via the ink supply passages 40.

The outer surfaces of the sheets 18 projecting upwardly beyond the actuator blocks 20 are bonded to the lateral walls of the recess 38 by means of an adhesive 44, so that the ink supply passages 40 are sealed and the channel plate 12 is held in firm engagement with the web portion 42 of the base plate.

The flexible lead foils 24 are led-out on either side of the base plate 10 and are protected against tensile forces by clamping bars 46 which, together with mounting blocks 48 (FIG. 1) form a frame surrounding the lower portion 36 of the base plate. In the shown embodiment, the printhead is a hot-melt ink jet printhead, and, as is known per se, heating means (not shown) are provided for heating the base plate 10 so that the hot-melt ink contained in the ink reservoir 32, the ink supply passages 40 and the ink channels 14 is maintained in the liquid state. If desired, electric auxiliary heating means can be formed in the channel plate 12, for example by appropriately doping the silicon material so that resistance heating layers are formed.

When the printhead is operated, electric signals are supplied to the individual piezoelectric fingers 22 via the lead foils 24, so that the piezoelectric fingers perform expansion and retraction strokes towards and away from the associated ink channel 14, so that the sheet 18 covering this ink channel is flexed and the liquid ink contained in the ink channel is pressurized and an ink droplet is jetted-out through the nozzle 16.

As can be seen in FIGS. 1 and 2, the amount of bulk material needed for the base plate 10 is considerably larger than the amount of material needed for the channel plate 12. It is accordingly an important advantage of the present invention that only the comparatively small channel plate 12 needs to be made of an expensive material such as silicon. In the manufacturing process, the pattern of ink channels 14 and nozzles 16 can be formed with high precision in both lateral surfaces of the channel plate 12 by using photolithographic etching techniques. Then, the ink channels are covered with the flexible sheets 18 and the actuator blocks 20 are secured thereto by bonding. The fact that, at this stage, the channel plate 12 is not yet fitted to the base plate 10, facilitates the fine adjustment of the piezoelectric fingers 22 of the actuator blocks relative to the ink channels 14. Finally, the unit formed by the channel plate, the flexible sheets 18 and the actuator blocks 20 is fitted to the base plate 10 and secured thereto by bonding.

Figure 3:
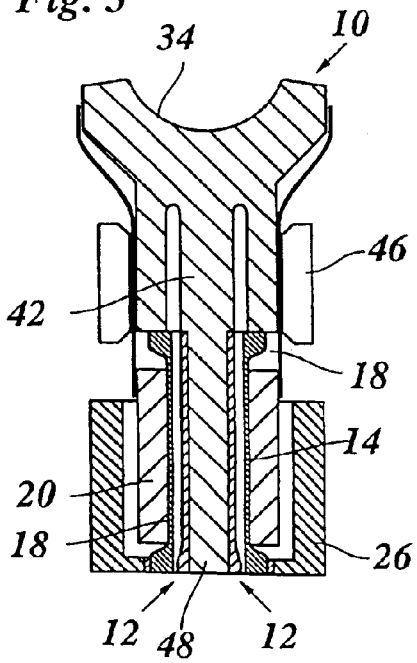
FIG. 3 is a cross-sectional view of a printhead according to a modified embodiment of the present invention.

FIG. 3 shows a modified embodiment in which the web portion 42 of the base plate 10, instead of forming the recess 38 shown in FIG. 2, is extended to form a support plate 48 sandwiched between two separate channel plates 12. In this embodiment, the amount of silicon material required for forming the two channel plates is even smaller than in the case of FIG. 2, and each channel plate forms only one row of ink channels 14. The thickness of the support plate 48 is preferably smaller than that of the web portion 42, so that the channel plates can be abutted against a shoulder formed between the support plate 48 and the web portion 42. The flexible sheets 18 are in this case made from slightly thicker plates which are in abutting engagement with the lower edge of the base plate 10 on either side of the projecting support plate 48 and from which a central portion has been etched away in order to accommodate the actuator blocks 20 and to provide the required flexibility.

The channel plates 12 are secured to the surfaces of the support plate 48 by means of an adhesive, which provides for a good thermal contact between the base plate 10 and the channel plates.

It is possible to use graphite for the base member 10 and the channel plate 12. In this situation graphite with carbon particles having a grain size greater than 10 $\mu$m is used for the base member 10 and for the channel plate 12, graphite with carbon particles having a grain size smaller than 10 $\mu$m, preferably smaller than 3 $\mu$m, is utilized.

Although only specific embodiments of the present invention have been described above, it will be clear for a person skilled in the art that various modifications and changes can be made within the scope of the appended claims.

What is claimed is:

1. An Ink jet printhead comprising a channel plate provided with a plurality of ink channels in at least one surface thereof, actuators respectively associated with each of the ink channels for pressurizing ink contained in the ink channels, a flexible sheet covering said surface of the channel plate wherein the plurality of ink channels are formed for preventing exposure of the actuators to ink, electrodes operatively associated with each of the actuators for individually energizing the actuators; and means defining an ink reservoir communicating with the ink channels, wherein said ink reservoir is defined by a base member made of a material different from that of the channel plate, wherein the channel plate is held in butting engagement with a surface of the base member in which an ink supply passage is formed for establishing fluid communication between the ink reservoir and the ink channels.

2. The Ink jet printhead according to claim 1, wherein an adhesive layer is provided between the channel plate and the base member.

3. The Ink jet printhead according to claim 1, wherein the channel plate is made of silicon.

4. The Ink jet printhead according to claim 1 and having two separate channel plates, wherein a portion of the base member forms a support plate sandwiched between the two separate channel plates.

5. An Ink jet printhead comprising a channel plate provided with a plurality of ink channels in at least one surface thereof, actuators respectively associated with each of the ink channels for pressurizing ink contained in the ink channels, and means defining an ink reservoir communicating with the ink channels, wherein said ink reservoir is defined by a base member made of a material different from that of the channel plate, said base member being made of graphite.

6. The ink jet printhead according to claim 5, wherein the channel plate is made of silicon.

7. The ink jet printhead according to claim 5, and having two separate channel plates, wherein a portion of the base member forms a support plate sandwiched between the two separate channel plates.

8. An ink jet printhead comprising:

a channel plate provided with a plurality of ink channels in at least one surface thereof;

a second channel plate having a plurality of ink channels etched into at least one surface thereof;

actuators respectively associated with each of the ink channels for pressurizing ink contained in the ink channels;

electrodes associated with each of the actuators for individually energizing the actuators; and a base member made of a material different from that of said first and said second channel plate, wherein an ink reservoir is formed, said ink reservoir communicating with the ink channels, and wherein a portion of the base member forms a support plate sandwiched between said first channel plate and said second channel plate.

* * * * *

UNITED STATES PATENT AND TRADEMARK OFFICE

CERTIFICATE OF CORRECTION

PATENT NO. : 6,874,869 B1
DATED : April 5, 2005
INVENTOR(S) : Peter Hollands et al.

It is certified that error appears in the above-identified patent and that said Letters Patent is hereby corrected as shown below:

Title page,
Item [73], Assignee, change from "Océ Technologies B.B. Ma Venlo (NL)" to -- Océ-Technologies B.V. Ma Venlo (NL) --.

Signed and Sealed this

Fourth Day of October , 2005

JON W. DUDAS
*Director of the United States Patent and Trademark Office*